US009408518B2

(12) United States Patent
Bradbury

(10) Patent No.: US 9,408,518 B2
(45) Date of Patent: Aug. 9, 2016

(54) RETAINERS FOR A DEVICE HAVING REMOVABLE FLOOR SHEETS

(71) Applicant: The Procter & Gamble Company, Cincinnati, OH (US)

(72) Inventor: Glenn Allen Bradbury, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 406 days.

(21) Appl. No.: 13/947,501

(22) Filed: Jul. 22, 2013

(65) Prior Publication Data

US 2014/0026344 A1 Jan. 30, 2014

Related U.S. Application Data

(63) Continuation-in-part of application No. 13/524,491, filed on Jun. 15, 2012, now Pat. No. 8,910,340.

(51) Int. Cl.

| | |
|---|---|
| ***A47L 11/33*** | (2006.01) |
| ***A47L 13/44*** | (2006.01) |
| ***A47L 11/40*** | (2006.01) |
| ***A47L 13/12*** | (2006.01) |

(Continued)

(52) U.S. Cl.

CPC ..... *A47L 13/44* (2013.01); *A47L 11/33* (2013.01); *A47L 11/4013* (2013.01); *A47L 11/4041* (2013.01); *A47L 11/4069* (2013.01); *A47L 11/4072* (2013.01); *A47L 13/12* (2013.01); *A47L 13/16* (2013.01); *A47L 13/20* (2013.01)

(58) Field of Classification Search

CPC ..... A47L 13/256; A47L 13/44; A47L 11/33
See application file for complete search history.

(56) References Cited

U.S. PATENT DOCUMENTS

| | | | |
|---|---|---|---|
| 9,783 | A | 6/1853 | Pusey |
| 306,008 | A | 9/1884 | Drew |

(Continued)

FOREIGN PATENT DOCUMENTS

| | | | |
|---|---|---|---|
| AU | 671431 | B2 | 8/1996 |
| CN | 2180195 | Y | 10/1994 |

(Continued)

OTHER PUBLICATIONS

PCT Search Report; Dtd Aug. 22, 2013; 10 Pages.

(Continued)

*Primary Examiner* — Randall Chin
(74) *Attorney, Agent, or Firm* — Larry L. Huston; Steven W. Miller

(57) ABSTRACT

A retainer for removably attaching a sheet to a cleaning device. The retainer has at least one cantilevered finger extending inwardly from the periphery of a cavity towards the inside of that cavity. Behind the retainer is a flexible barrier, at least partially covering the back of the cavity. The barrier prevents the user's finger from going too far into the cavity and becoming pinched, and allows the thickness of the device to which the sheet is attached to be reduced compared to a device having a conventional sheet retainer. The barrier may provide visual and/or tactile barrier cues to a user, qualitatively signaling the user which direction is proper for insertion of the sheet into the retainer and quantitatively signally the user how far the sheet should be inserted into the retainer. Strands and/or a membrane panel which are elastic or inelastic may be used for the barrier.

19 Claims, 7 Drawing Sheets

(51) Int. Cl.
*A47L 13/16* (2006.01)
*A47L 13/20* (2006.01)

(56) References Cited

U.S. PATENT DOCUMENTS

| | | | | | |
|---|---|---|---|---|---|
| 329,257 | A | | 10/1885 | Bissell | |
| 2,178,917 | A | | 11/1939 | Pullen | |
| 2,510,114 | A | * | 6/1950 | Hummel | E21B 33/08 15/220.4 |
| 3,034,165 | A | | 5/1962 | Christian | |
| 3,099,855 | A | | 8/1963 | Nash | |
| 3,237,846 | A | * | 3/1966 | Brown | A47L 9/1454 383/61.1 |
| 3,760,450 | A | | 9/1973 | Griffin et al. | |
| 3,789,947 | A | | 2/1974 | Blumrich et al. | |
| 3,792,505 | A | | 2/1974 | Saltzstein | |
| 3,827,100 | A | * | 8/1974 | Griffin | A47L 13/20 15/145 |
| 3,877,103 | A | | 4/1975 | Nash | |
| 3,984,221 | A | * | 10/1976 | Cotton, Jr. | B01D 46/005 55/484 |
| 4,191,609 | A | | 3/1980 | Trokhan | |
| 4,224,753 | A | | 9/1980 | Bielman | |
| 4,369,539 | A | | 1/1983 | Nordeen | |
| 4,637,859 | A | | 1/1987 | Trokhan | |
| 4,654,927 | A | | 4/1987 | Novinger | |
| 4,701,969 | A | | 10/1987 | Berfield et al. | |
| 4,709,436 | A | | 12/1987 | Berfield et al. | |
| 4,971,471 | A | * | 11/1990 | Sloan | A47L 13/20 15/210.1 |
| 5,208,935 | A | | 5/1993 | Jailor et al. | |
| 5,426,809 | A | | 6/1995 | Muta | |
| 5,461,749 | A | | 10/1995 | Ahlberg et al. | |
| 5,539,953 | A | | 7/1996 | Kurz | |
| 5,655,250 | A | | 8/1997 | Warrell | |
| 5,815,878 | A | | 10/1998 | Murakami et al. | |
| 5,876,141 | A | | 3/1999 | Hsu | |
| D409,343 | S | | 5/1999 | Kingry et al. | |
| 5,901,411 | A | | 5/1999 | Hato et al. | |
| 5,904,200 | A | * | 5/1999 | Agen | E06B 9/52 160/371 |
| 5,960,508 | A | | 10/1999 | Holt et al. | |
| 6,048,368 | A | | 4/2000 | Tcheou et al. | |
| 6,098,239 | A | | 8/2000 | Vosbikian | |
| 6,101,661 | A | | 8/2000 | Policicchio et al. | |
| 6,305,046 | B1 | | 10/2001 | Kingry et al. | |
| 6,386,392 | B1 | | 5/2002 | Argentieri et al. | |
| 6,651,290 | B2 | | 11/2003 | Kingry et al. | |
| D487,173 | S | | 2/2004 | Clare et al. | |
| 6,716,805 | B1 | | 4/2004 | Sherry et al. | |
| 6,792,648 | B2 | | 9/2004 | Lee | |
| 6,797,357 | B2 | | 9/2004 | Fereshtehkhou et al. | |
| 6,823,558 | B2 | | 11/2004 | Lee | |
| 6,936,330 | B2 | | 8/2005 | Fereshtehkhou et al. | |
| 7,013,528 | B2 | | 3/2006 | Parker et al. | |
| 7,117,556 | B2 | | 10/2006 | Grey | |
| 7,134,161 | B2 | | 11/2006 | Campos | |
| 7,137,169 | B2 | | 11/2006 | Murphy et al. | |
| 7,144,173 | B2 | | 12/2006 | Policicchio et al. | |
| 7,293,322 | B2 | | 11/2007 | Matousek et al. | |
| 7,318,628 | B2 | | 1/2008 | Guile | |
| 7,346,428 | B1 | | 3/2008 | Huffman et al. | |
| D588,770 | S | | 3/2009 | Koenig et al. | |
| 7,516,508 | B2 | | 4/2009 | Stackpole et al. | |
| 7,536,743 | B2 | | 5/2009 | Goh et al. | |
| 7,676,877 | B2 | | 3/2010 | Policicchio et al. | |
| 7,805,795 | B2 | | 10/2010 | Stein et al. | |
| 8,061,546 | B2 | | 11/2011 | Ramsey | |
| 8,185,995 | B2 | | 5/2012 | Sjoeberg | |
| 8,186,898 | B2 | | 5/2012 | Bradbury et al. | |
| 8,186,989 | B2 | | 5/2012 | Yamaura et al. | |
| 8,214,960 | B1 | | 7/2012 | Rupp | |
| 8,230,540 | B1 | | 7/2012 | Nelson | |
| 8,443,478 | B2 | | 5/2013 | West et al. | |
| 2004/0045126 | A1 | | 3/2004 | Parker et al. | |
| 2005/0055792 | A1 | | 3/2005 | Kisela et al. | |
| 2005/0081888 | A1 | | 4/2005 | Pung et al. | |
| 2005/0181968 | A1 | | 8/2005 | Policicchio et al. | |
| 2005/0241086 | A1 | | 11/2005 | Damrath et al. | |
| 2008/0018167 | A1 | | 1/2008 | Fuji | |
| 2009/0000051 | A1 | | 1/2009 | Rosenzweig et al. | |
| 2009/0044351 | A1 | | 2/2009 | Menrik et al. | |
| 2009/0077761 | A1 | | 3/2009 | Kaleta et al. | |
| 2009/0077764 | A1 | | 3/2009 | Hazen et al. | |
| 2009/0223007 | A1 | | 9/2009 | Li | |
| 2010/0187779 | A1 | | 7/2010 | Potter | |
| 2010/0243342 | A1 | | 9/2010 | Wu et al. | |
| 2010/0287716 | A1 | | 11/2010 | Kasper et al. | |
| 2011/0126367 | A1 | | 6/2011 | Wolf et al. | |
| 2011/0219557 | A1 | | 9/2011 | Rosenzweig et al. | |
| 2012/0096662 | A1 | | 4/2012 | Uchiyama et al. | |
| 2013/0333129 | A1 | | 12/2013 | Willey et al. | |
| 2014/0026344 | A1 | | 1/2014 | Bradbury | |

FOREIGN PATENT DOCUMENTS

| | | | |
|---|---|---|---|
| CN | 201346183 | U | 11/2009 |
| EP | 0825824 | B1 | 4/1996 |
| EP | 1027855 | A2 | 8/2000 |
| EP | 0980224 | B1 | 4/2006 |
| EP | 1330978 | B1 | 2/2008 |
| GB | 583 738 | A | 12/1946 |
| GB | 2389035 | B | 5/2006 |
| JP | 09322872 | A | 12/1997 |
| JP | 10113314 | A | 5/1998 |
| JP | 10262886 | A | 10/1998 |
| JP | 2002209809 | A | 7/2002 |
| JP | 2003135348 | A | 5/2003 |
| JP | 2004229953 | A | 8/2004 |

OTHER PUBLICATIONS http://www.swiffer.com/products/swiffer-sweep-trap; Downloaded May 13, 2014; Swiffer Sweep & Trap with sheet attached enclosed; First delivery date Dec. 9, 2013.

Swiffer Sweeper Implement with Swiffer Dry Cloth Refill and Swiffer Wet Cloth Refill, all currently sold by Assignee.

* cited by examiner

RETAINERS FOR A DEVICE HAVING REMOVABLE FLOOR SHEETS

FIELD OF THE INVENTION

The present invention relates to retainers for devices having a removable floor sheet, which floor sheet is usable to clean a floor or other hard surface.

BACKGROUND OF THE INVENTION

Cleaning of hard surfaces, such as floors (vinyl, linoleum, tile, cement), countertops, showers, etc. is well known in the art. Cleaning may be accomplished using cellulosic paper towels and non-woven sheets, as are well known in the art. Nonwoven sheets may be made according to commonly assigned U.S. Pat. Nos. 6,936,330 and/or 6,797,357. Cellulosic paper towels may be made according to commonly assigned U.S. Pat. Nos. 4,191,609 and/or 4,637,859.

Such sheets have been removably attached to manual cleaning devices. The devices increase reach, and improve ergonomics. For example, when the hard surface to be cleaned is a floor, the device allows the user to clean from a standing position, improving comfort over cleaning from a crouched position or on the knees. Manual devices may be made according to 2009/0077761; U.S. Pat. No. 7,346,428 and commonly assigned U.S. Pat. Nos. 6,305,046; 7,676,877 and/or D588,770.

To assist with loose, large particle cleaning, rotatable beater bars have been utilized, as disclosed in U.S. Pat. No. 9,783, reissued Jun. 28, 1881; U.S. Pat. No. 306,008 issued Sep. 30, 1884; U.S. Pat. No. 329,257 issued Oct. 27, 1885; U.S. Pat. No. 4,654,927 issued Apr. 7, 1987; and U.S. Pat. No. 7,134,161 issued Nov. 14, 2006. The beater bars in these teachings are driven by the wheels. Particularly, each of these references teaches plural wheels contacting the floor to be cleaned. The wheels drive the beater bar, obviating the need for a separate electric motor. Electric motors add cost and weight to the device. Split beater bars have also been used, as shown in 2005/0055792 and U.S. Pat. No. 7,134,161.

In addition to or instead of a beater bar, the device may use a vacuum to remove debris from the floor. Vacuum may be accomplished with a fan to provide suction, as disclosed in U.S. Pat. Nos. 7,137,169 and 7,293,322.

But with all of these enhancements to the device, the problem of removably attaching the sheet to the device persists. Hook and loop attachments have been suggested, e.g. U.S. Pat. No. 3,792,505, but can be rendered ineffective by fibers which come off the sheet when it is removed. Likewise, adhesive attachment can be blocked over time. Looped straps were proposed in U.S. Pat. No. 2,301,586, but have the drawback of requiring a dedicated attachment, such as a nail. Clamps have been proposed, e.g. U.S. Pat. Nos. 5,426,809 and 5,815,878, but can be difficult to manipulate and may come loose over time.

Resilient retainers have been used to removably hold the sheet onto the foot of the device. These retainers use resilient fingers disposed around a cavity. The fingers extend from respective proximal ends juxtaposed with the cavity periphery to respective distal ends disposed in the cavity. The fingers may be generally planar and lying within the plane of the cavity opening or may extend into or out of the cavity.

Suitable retainers may be made according to commonly assigned U.S. Pat. No. 6,651,290, particularly column 4, lines 15-65; U.S. Pat. Nos. 7,516,508, 7,536,743, D409,343 and D487,173 or according to U.S. Pat. Nos. 3,099,855; 3,760,450; 3,877,103; 5,876,141; and 6,098,239.

But these retainers do not solve the problem of fingers being pinched by the resilient fingers. If the fingers are too stiff, insertion of the cleaning sheet becomes difficult. If the fingers are too flexible, the sheet may not be retained throughout the cleaning task. Accordingly, another approach is necessary.

Furthermore, these retainers do are not suited for devices having a foot which does not have sufficient space under the cavity. For example, if the foot is thin, the fingers may be visible from and accessed from either side. If the user is not familiar with the proper sheet attachment, s/he may attach the sheet to the wrong side of the foot. Accordingly, another approach is necessary.

SUMMARY OF THE INVENTION

The invention comprises retainer for a cleaning device. The device has a foot which removably accepts a disposable floor sheet. One or more retainers may be used to attach the floor sheet to the foot. The retainers comprise cantilevered resilient fingers, extending into a cavity. A flexible barrier is disposed behind the fingers. Upon deflection of at least one finger, it contacts the barrier. An optional handle may be pivotally attached to the foot.

DETAILED DESCRIPTION OF THE INVENTION

Figure 1:
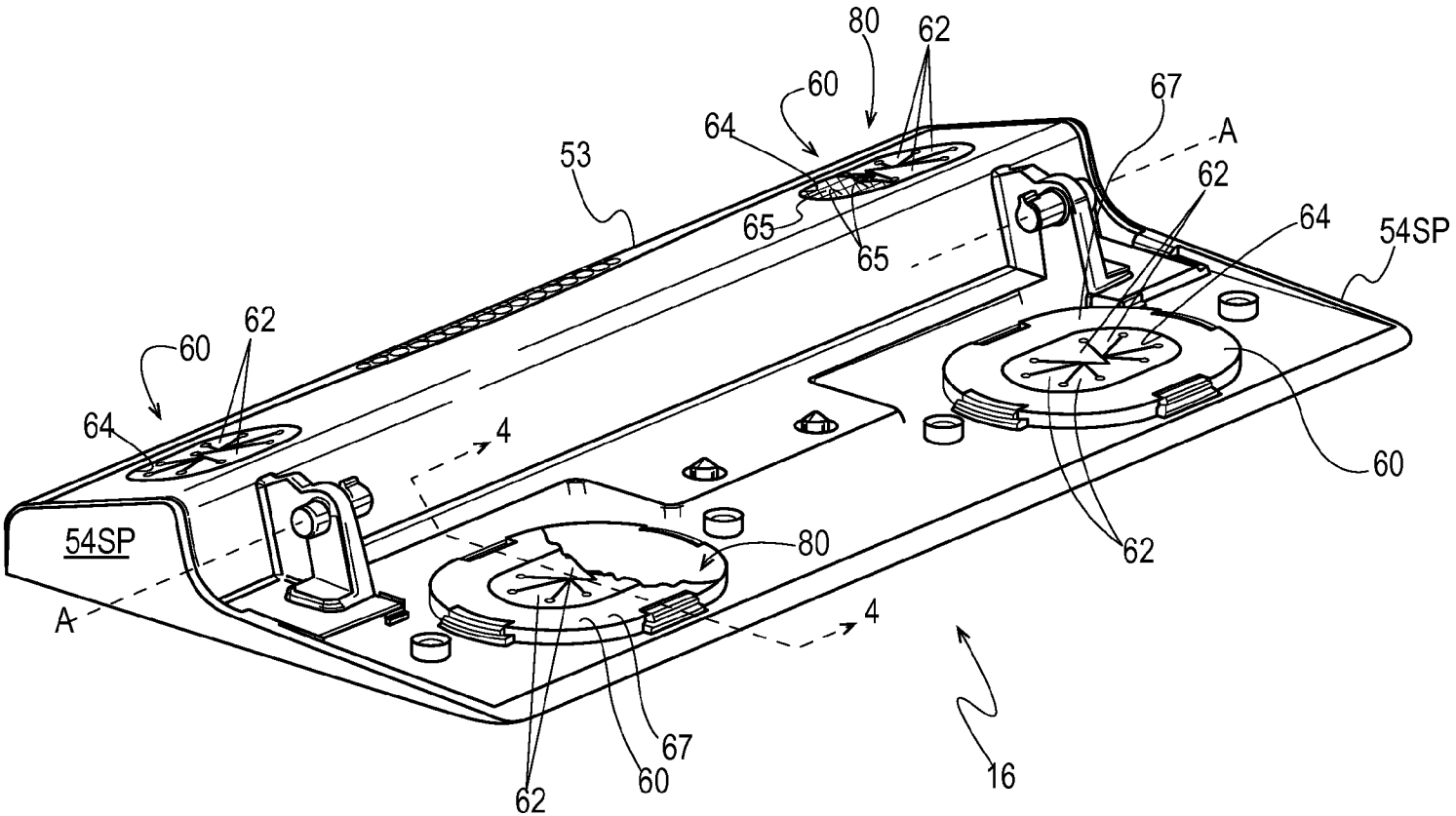
FIG. 1 is a perspective view of a foot having four retainers, the retainers being made according to the present invention, with two retainers being shown partially in cutaway.

Referring to FIG. 1, the invention comprises a retainer for use with a cleaning device (10). It is to be understood the device (10) may have at least one such retainer, and more particularly, may have four retainers (60), one for each corner of a cleaning sheet (20). The retainers (60) may define a plane, which plane may be generally aligned with the surface of the cleaning device (10).

Figure 2:
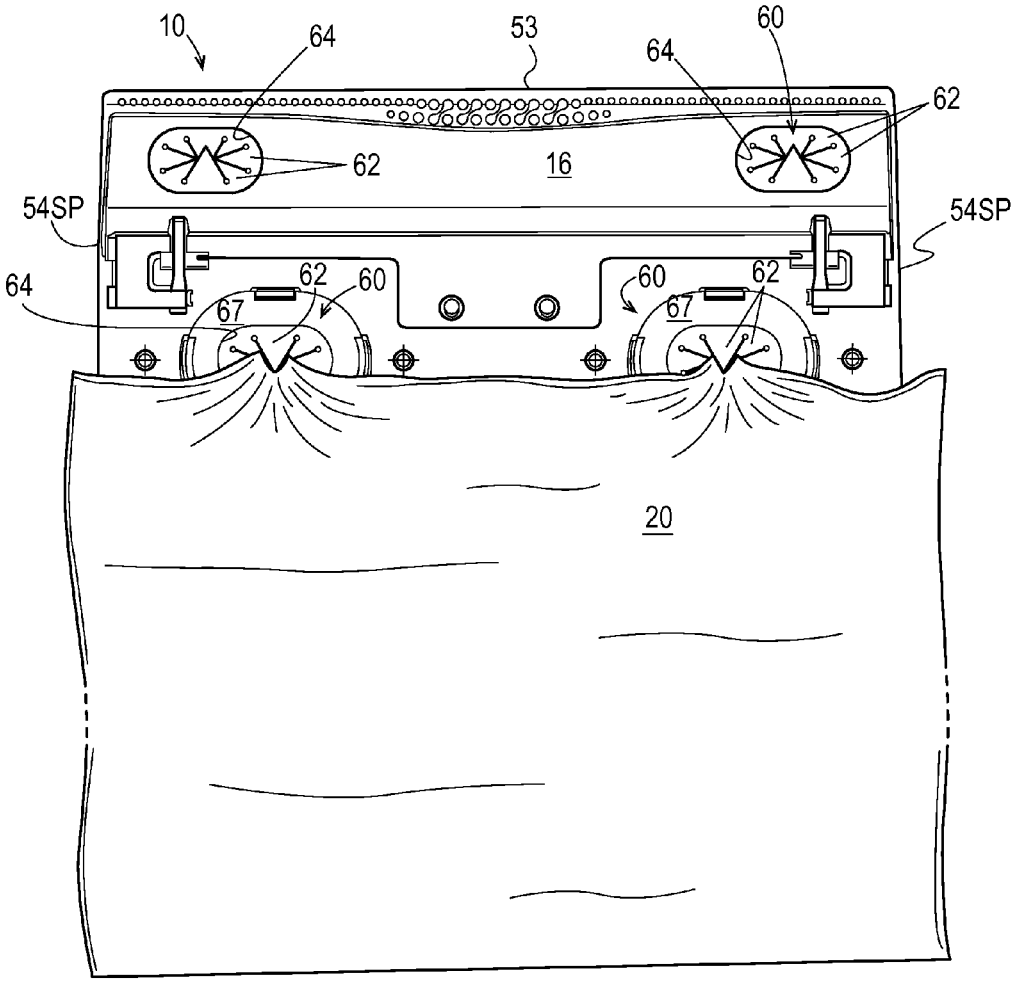
FIG. 2 is a top plan view of the foot of FIG. 1 without a cutaway view and having a sheet attached to each of the two retainers.
Figure 3:
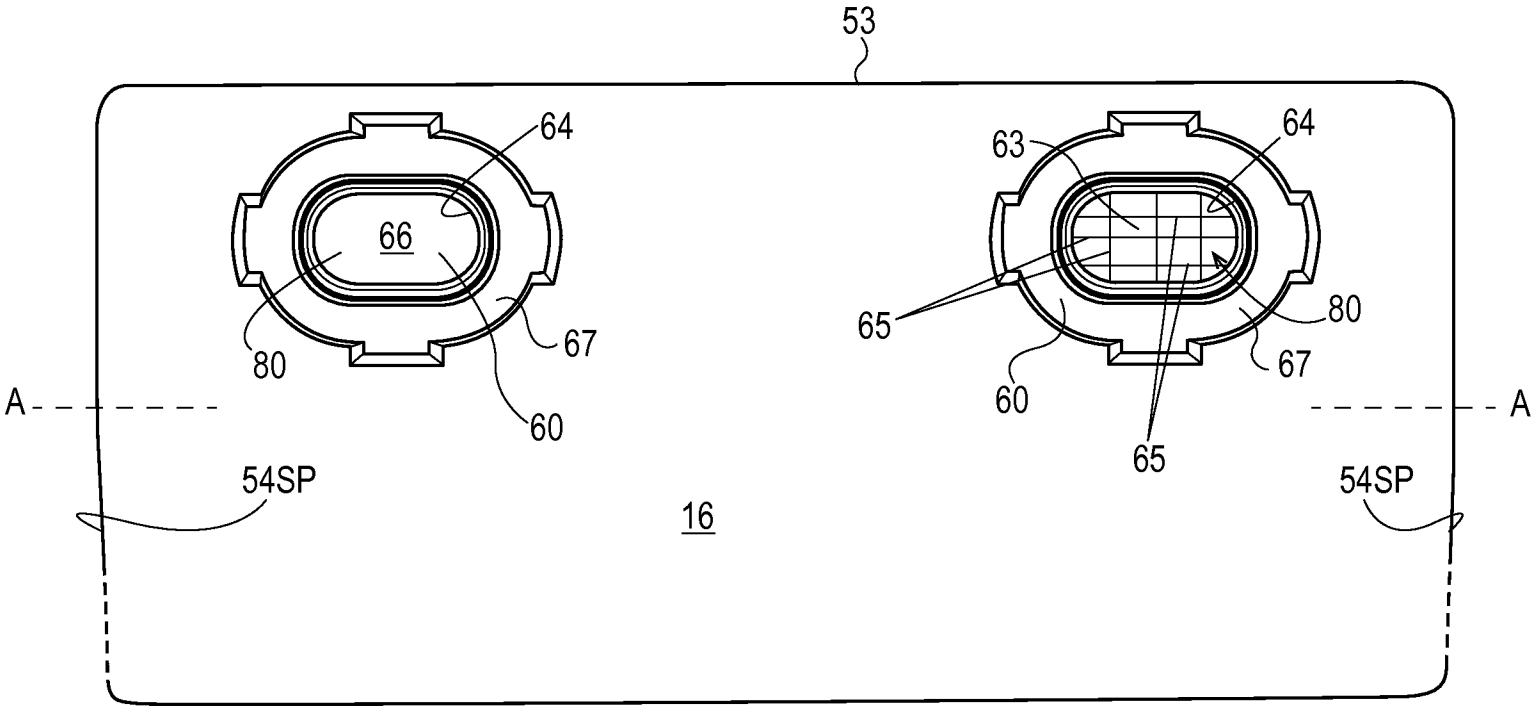
FIG. 3 is a bottom plan view of the foot of FIG. 1, showing the left retainer having an flexible membrane backing and the right retainer having a flexible strand backing.

Referring to FIGS. 2 and 3, the retainers (60) may define a cavity (63) having a front and a back. The sheet (20) is inserted through the front of the retainer, into engagement with one or more resilient fingers (62). The fingers (62) may be cantilevered from the periphery of the cavity (63).

The back of the cavity (63) may be at least partially occluded by or covered with a barrier (80), such as elastic membrane (66). The barrier (80) may perform the barrier functions of preventing the user's finger from entering the cavity (63) in the wrong direction and also preventing the user's finger from penetrating too far into the cavity (63) from the front to back direction, as shown by arrow F in FIG. 4B. The barrier (80) may cross the perimeter (64) in any desired direction, so that the barrier (80) provides a tactile and/or visual barrier to improper use/operation of the retainer (60).

The barrier (80) may be flexible. By flexible it is meant that the barrier (80) deforms under normal forces encountered in use when deflected by a finger (62). Such deflection may occur when a user is installing a sheet (20) into or even removing a sheet (20) from the retainer (60). The barrier (80) may further be resilient. By resilient it is meant that the barrier (80) generally returns to its original position when the deflection from the fingers (62) is removed. A resilient barrier (80) provides the benefit of increased tactile sensation to the user as s/he inserts the sheet (20) into the retainer (60). Thus, upon deflection, of at least one finger (62), and optionally prior thereto, the finger (62) contacts the barrier (80).

In one embodiment, the finger (62) and barrier (80) may be in contacting relationship in the free state. This arrangement advantageously allows for minimizing the thickness of the foot (14). In another embodiment, the finger (62) and bather (80) may be juxtaposed, but not in contacting relationship until the finger (62) is bent or deflected by the user.

The barrier (80) may provide visual and/or tactile barrier cues to a user. For example, the barrier (80) may qualitatively signal to the user which direction is proper for insertion of the sheet (20) into the retainer (60). The barrier (80) may further quantitatively signal to the user how far the sheet (20) should be inserted into the retainer (60) and particularly signal when full insertion is reached.

If an elastic membrane (66) is selected for the resilient barrier (80), the elastic membrane (66) deforms out of the plane of the cavity (63) in response to user-applied forces applied against the fingers (62). The forces may be applied with a vector component normal to the fingers (62) and/or membrane (66).

This arrangement allows the device (10) to be used with a foot having a sole plate (16) which is advantageously rigid. By rigid it is meant that the sole plate (16) does not deform under normal usage conditions, such as cleaning and installing/removing the cleaning sheet (20). A rigid sole plate (16) provides the benefit that the sole plate (16) may pivot relative to the housing (50) without undue deformation and possibly becoming loose over time. But a rigid sole plate (16) without the retainers (60) of the claimed invention does not easily allow for a thinner foot (14) or advantageous tactile sensation. One of skill will recognize the retainers (60) of the claimed invention are equally applicable to a device (10) with or without a handle (12) and having a conventional foot (14), as shown in commonly assigned U.S. Pat. No. 6,484,356. Such a conventional foot (14) does not have plural members, e.g. housing (50)/sole plate (16) which move relative to one another.

Figure 4A:
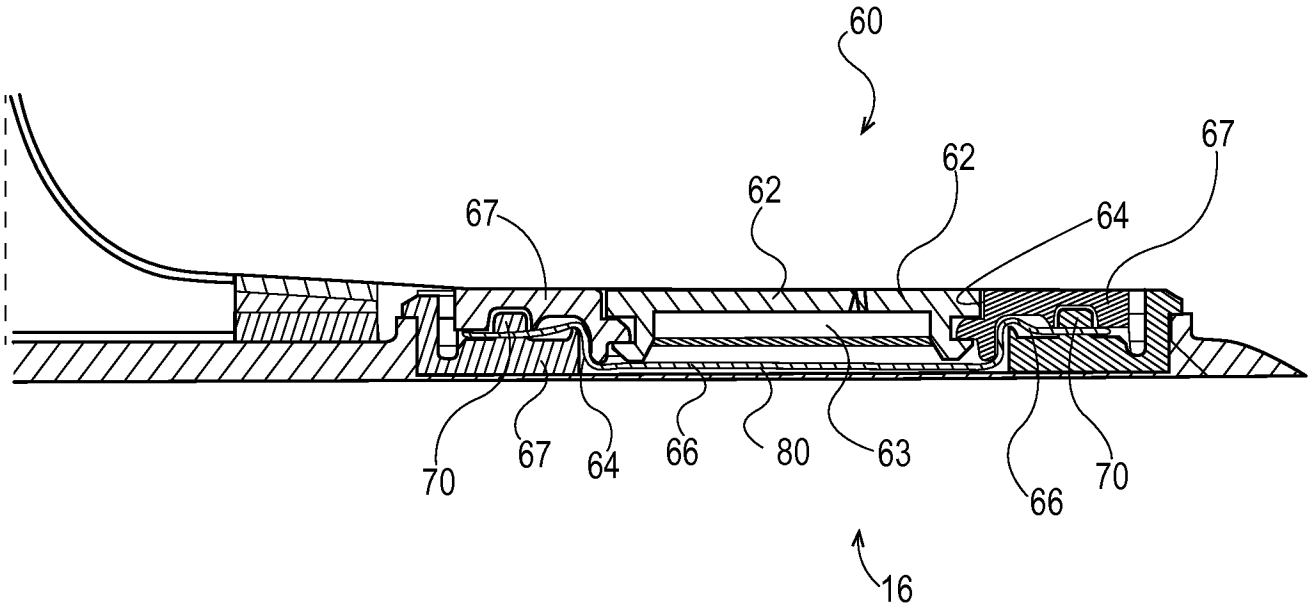
FIG. 4A is an instantaneous fragmentary vertical sectional view taken along line 4-4 of FIG. 1, showing the finger and membrane in a first, free configuration.
Figure 4B:
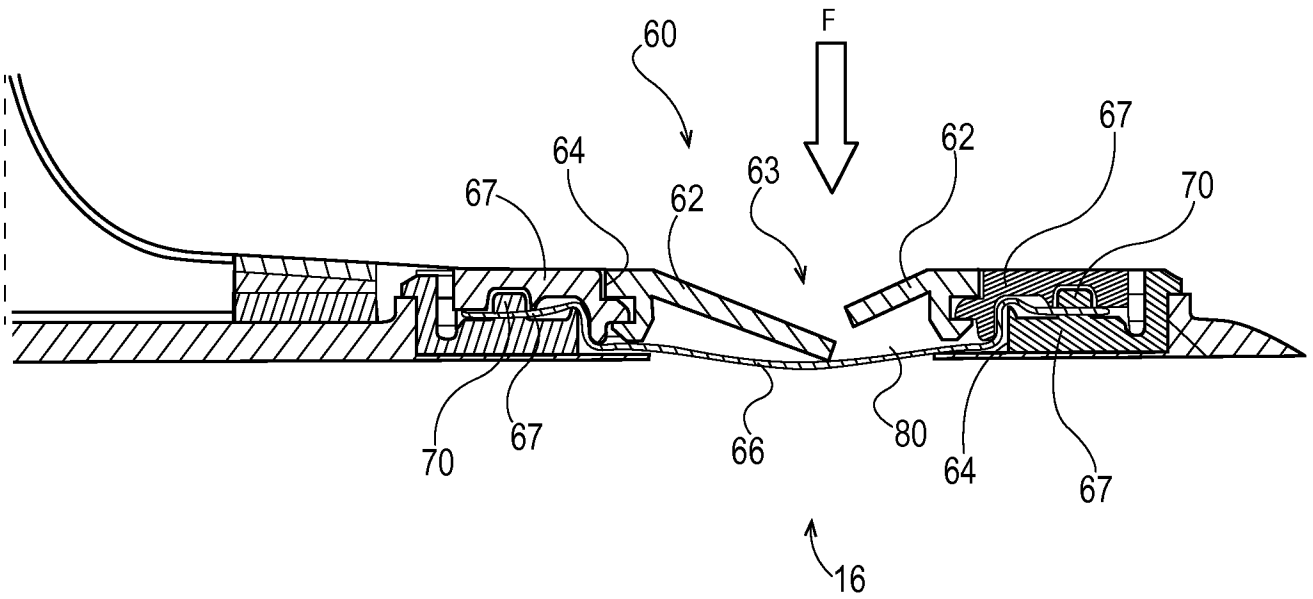
FIG. 4B is an instantaneous fragmentary vertical sectional view taken along line 4-4 of FIG. 1, showing the finger and membrane in a second, deflected configuration.

Referring to FIGS. 1, 4A and 4B, the retainer cavity (63) comprises a perimeter (64). An oval is shown, although one of skill will recognize the invention is not so limited. The cavity (63) may comprise a circle, rectangle, and other symmetric or irregular shapes, as desired. The cavity (63) perimeter (64) is shown as being planar, although one of skill will recognize the invention is not so limited.

The perimeter (64) may have a minimum dimension of 14, 12 or 10 mm in any direction. This dimension is sized to comfortably allow the user's finger, typically an index finger, to attach the sheet (20).

One or more fingers (62) extend from a proximal end on the perimeter (64) to a distal end in the cavity (63). The fingers (62) are shown as being within the plane of the perimeter (64) of the cavity (63), although one of skill will recognize the invention is not so limited. Without regard to whether or not the perimeter (64) is planar, the fingers (62) may extend into the cavity (63) in a planar manner as shown. Alternatively the fingers (62) may extend outwardly from the cavity (63) and away from the surface of the foot (14) of the device (10). Alternatively the fingers (62) may extend inwardly towards the back of the cavity (63).

The fingers (62) may be generally flat as shown, have a round cross section, I beam shaped cross section, etc. The fingers (62) may be of constant or variable width including tapered as shown, may be of constant thickness as shown, or variable thickness, etc. as necessary to provide the desired bending stiffness. The fingers (62) may be cantilevered from a proximal end juxtaposed with the perimeter (64) and taper to a point at the distal end. The point is useful for engaging the sheet (20) to prevent unintentional sheet (20) dislodging during use.

The fingers (62) may be of similar geometry and/or stiffness or may have different geometries, as shown. One or more fingers (62), and particularly at least one distal end thereof, may contact the barrier (80) in use to cause deflection thereof. Such deflection of the barrier (80) may provide a tactile and/or visual signal to the user during sheet (20) insertion/removal.

Behind the finger (62) is a membrane (66) which may be a resilient membrane (66). By resilient it is meant the membrane (66) deforms normal to the plane of the cavity (63) under insertion force applied by the user to the finger(s) (62) and returns to its original configuration when the insertion force is removed.

Referring to FIG. 3, the membrane (66) may be congruent with the cavity (63) perimeter (64) and extend throughout the cavity (63). If desired, the membrane (66) may be larger than the cavity (63), so that the membrane (66) may unexpectedly minimize occurrences of the user's finger being pinched by the retainer finger (62). The membrane (66) may be held in place in the foot (14) with a collar (67).

Referring to FIGS. 3, 4A and 4B, the collar (67) may function as an insert between the membrane (66) and the foot (14). The membrane (66) may be stretched and held in place by the collar (67). Alternatively, the membrane (66) may be held in place by adhesive or other attachment to the wall of the foot (14).

Referring particularly to FIGS. 4A and 4B, the membrane (66) and the fingers (62) may be spaced apart in the direction perpendicular the plane of the cavity (63) at least 2, 4, 6 or 8 mm and less than 10 mm. This spacing unexpectedly provides for the retainer to be used with a thinner foot (14) geometry than is necessary if the cavity (63) has to be deep enough to allow sheet (20) insertion without the membrane (66) present. The spacing is measured as the closest distance between the bather (80) and finger (62) using a common ruler.

Alternatively, the membrane (66) and fingers (62) may be juxtaposed and in contact with one another in the free position. This arrangement prophetically provides an even thinner foot (14) geometry.

Referring particularly to FIG. 4B, the finger (62), and particularly the distal end thereof, may contact the membrane (66) upon deflection towards the membrane (66). Such contact will likewise deform the membrane (66) in the same direction. The finger (62) may particularly deflect, in response to sheet (20) insertion force applied by the user in a first direction generally perpendicular to the plane of the cavity (63) as designated by arrow F.

Figure 6:
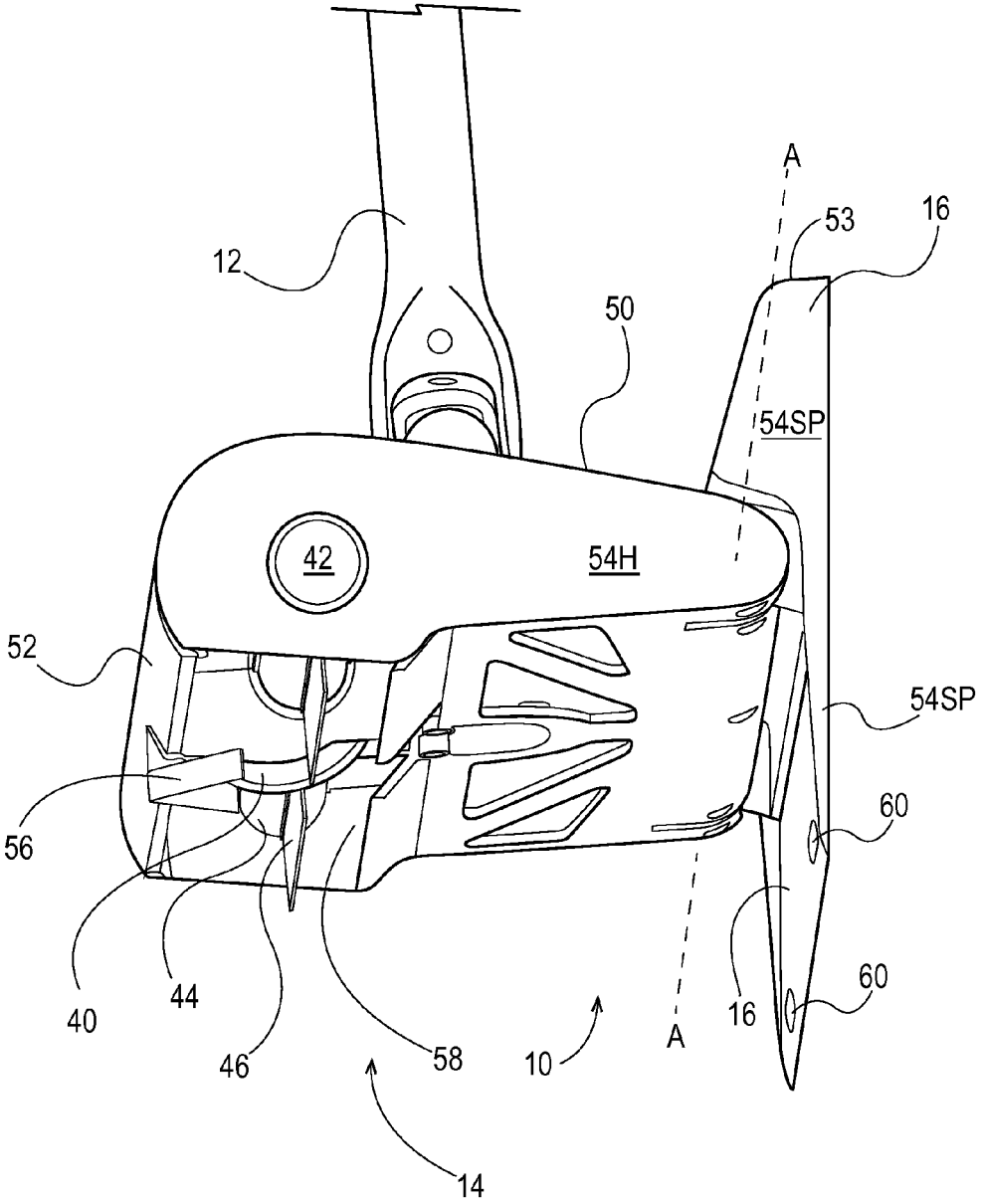
FIG. 6 is a bottom perspective view of a device of the present invention, with the foot pivoted to the open position and exposing two retainers optionally made according to the present invention.

Referring to FIG. 6, if a device (10) having a relatively thin sole plate (16) is desired, one or more retainers (60) having a membrane (66) may be disposed on the inner surface of the sole plate (16). The retainer of this invention unexpectedly allows for the sole plate (16) to be thin enough to pivot to a closed position underneath the housing (50) during use. Prophetically, the retainer of the present invention may unexpectedly utilize shorter fingers (62), conserving material without undue occurrences of the sheet (20) becoming dislodged during use.

The membrane (66) may be taut, optionally pre-tensioned and optionally bilaterally pre-tensioned. By pre-tensioning, it is meant that the membrane (66) is under tension while spaced from and not in contact with the fingers (62). This arrangement provides the benefit that less deflection of the finger (62) is necessary to deflect the membrane (66) sufficiently to cause the membrane (66) to resist the finger (62) deflection and return to the original configuration.

If desired, the membrane (66) may be flaccid, and optionally convex. This arrangement allows for longer fingernails to be used without tearing the membrane (66). Alternatively, the membrane (66) may be thicker near the center of the cavity (63), providing increased return force upon deformation. While a solid membrane (66) is shown, one of skill will recognize a perforate or aperture membrane (66) may also be used.

Referring to FIGS. 1, 4A and 4B, the membrane (66) may have a Shore A hardness of to 40 to 60, and particularly 48 to 52, as measured by GB/T531-1992. The tear strength may be at least 12, 14, 16, or 18 KN/M as measured by GB/T529-1999. The elongation may be at least 200, 250, 320 or 420% as measured by GB/T528-1998. The membrane (66) may comprise 60 to 80 weight percent methyl vinyl silicone, 18-36 weight percent silicone dioxide, and balance of other materials. If desired, a zero strain elastic may be utilized, as disclosed in commonly assigned U.S. Pat. No. 5,143,679 may be used for the membrane (66). An elastomeric polymer film and/or elastomeric polymers embedded into non-wovens, such as Flex Feel™, Flex Aire™, Extra Flex™ and Fabri Flex™ available from Tredegar Corp. of Richmond, Va. may be used for the membrane (66). A heat cured silicone elastomer, such as GF(E)-151 from Momentive Fine Performance Materials Shenzhen Co. of Shenzhen, China may be used for the membrane (66). A polymer which can be formed into non-woven fabrics to create elastic properties such as MD6717, MD6705, and G1643 available from Kraton Polymers LLC of Houston, Tex. may be used for the membrane (66).

The membrane (66) may have holes therethrough and be attached to the collar (67) via upstanding posts (70). A post (70) may be inserted through a respective hole, so that the membrane (66) does not become dislodged over the life of the foot (14).

In an alternative embodiment, prophetically the barrier (80) need not be resilient. The barrier (80) may, for example, comprise a membrane (66) made of nonwoven material, formed film, or similar material as are known in the art. The material for such membrane may be either flaccid or taut. The non-resilient membrane (66) may function as a visual and or tactile barrier (80) to the cavity (63) as described above.

Referring particularly to the right side of FIG. 3, in an alternative embodiment, the resilient barrier (80) may comprise one or more flexible strands (65). The strands (65) may perform the barrier functions, similar to membrane (66), of preventing the user's finger from entering the cavity (63) in the wrong direction and also prevent the user's finger from penetrating too far into the cavity (63) from the front to back direction, as shown by arrow F in FIG. 4B. The at least one strand (65) may cross the perimeter (64) in any desired direction, so that the strand (65) provides a tactile and/or visual barrier to improper use/operation of the retainer (60).

The strands (65) may be resilient, i.e. elastic or inelastic. The strands (65) may be disposed in a regular grid, as shown, a radial pattern, a random pattern, etc.

Elastic strands (65) may prophetically be flaccid, taut or pre-tensioned, as discussed above with respect to the membrane (66) type of barrier (80). Suitable elastic strands (65) may be Fulflex System 7000 rubber bands and TEX3CW15 TPE tape, both available from Fulflex, Inc of Brattleboro, Vt. 05301 and also LYCRA elastomer strands (65) available from EI DuPont de Nemours and Co of Wilmington, De., within the range of about 470-1500 decitex and particularly 620-1050 decitex. Inelastic stands may comprise common nylon or cotton string, etc.

One of skill will recognize that a particular retainer (60) is not limited to one set of fingers (62) and/or barriers (80). Plural barriers (80), particularly hybrid barriers (80) may be used, for example in series. The user's finger may encounter a first barrier (80) which is flaccid, which sends a first tactile signal. Then upon further deflection the user may encounter a second barrier (80) which is elastic and which provides a second, and optionally stronger signal that appropriate finger (62) deflection has been reached.

Optionally, the same barrier (80) may comprise two or more membranes (66), or membrane(s) 66 coupled with strands (65). For example one or more strands (65) may be used behind a membrane (66) as reinforcement. Such arrangement may be advantageous if an elastic strand (65) is used behind a flaccid membrane (66).

Prophetically a membrane (66) barrier (80) provides a better visual barrier than a strand (65) barrier (80). Conversely, a strand (65) barrier (80) is prophetically less expensive than a membrane (66) barrier (80).

Figure 5:
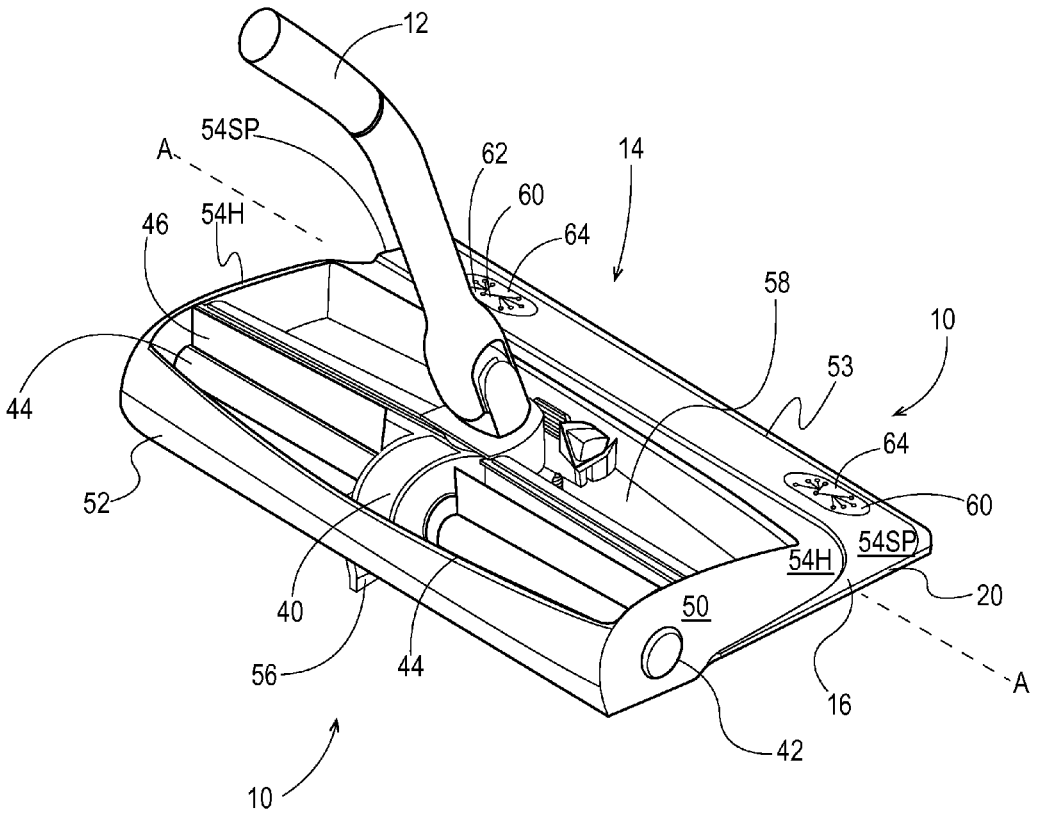
FIG. 5 is a top perspective view of a device, having a foot shown partially in cutaway and two exposed retainers optionally made according to the present invention.

Referring to FIGS. 5-6, the invention may be used with a surface cleaning device, (10) with an axially rotatable beater bar (44) and/or a vacuum nozzle (not shown), to remove debris from the floor. The beater bar (44) may sweep loose debris into a dirt bin (58), as described in 2010/0287716.

The device (10) may comprise a handle (12) and foot (14) mounted thereto in pivoting single axis as occurs with a hinge, or pivoting multi-axis relationship as occurs with a universal joint connection. Alternatively, if a small hand-held device (10) is desired, the handle (12) and foot (14) may be disposed in fixed relationship, so that countertops, showers and similar surfaces may be cleaned. The foot (14) may comprise a housing (50) and a sole plate (16) pivotally attached thereto. The foot (14), and particularly the sole plate (16) may removably receive a sheet (20) on the bottom thereof, so that such sheet (20) can slidably contact the floor during cleaning.

The device (10) may optionally comprise an axially rotatable beater bar (44) having opposed ends (42) and one or more bristles or blades (46) to remove debris from the floor. The beater bar (44) may be electrically powered, as is known in the art. The beater bar (44) may sweep loose debris into a dirt bin (58), as described in 2010/0287716.

With continuing reference to FIGS. 5 and 6, the foot (14) may comprise a footprint large enough to accommodate the floor sheet (20) and beater bar (44). The foot (14) may be generally rectangular, having a housing (50) with a front (52), and two spaced apart sides (54H). The spaced apart sides (54H) define a housing (50) width therebetween.

The foot (14) may comprise two symmetrically opposite mirror images, disposed about a longitudinal centerline. The user may generally push the device (10) from front (52) to rear (53), and back, in a series of strokes.

The sole plate (16) may have a rectangular footprint on the target surface. The sole plate (16) may form the rear (53) of the foot (14) and have two spaced apart sides (54SP). The spaced apart sides (54SP) define a sole plate (16) width therebetween.

The sole plate may (16) have an inner surface and outer surface opposed thereto. The inner surface may face the bottom of the housing (50) where the sole plate (50) is in a closed position. By attaching the floor sheet (20) only to the sole plate (16), the user may pivot the housing (50) from a first closed position, as shown in FIG. 5 to an open position as shown in FIG. 6.

Both the inner surface and outer surface of the sole plate (16) may have one or more retainers (60) thereon. This arrangement advantageously allows the floor sheet (20) to be attached to the sole plate (16) of the device (10) independent of and without attachment to the housing (50) of the device (10). By attaching the floor sheet (20) only to the sole plate (16), which floor plate (16) may pivot or float as moved across the floor, better contact with the floor may occur and cleaning may be enhanced.

More particularly, the floor sheet may wrap the distal edge of the sole plate (16), and be attached to retainers (60) on both opposed surfaces thereof. This arrangement provides the benefit that a conventional, flat as manufactured, floor sheet (20) may be utilized. Furthermore, by wrapping the distal edge of the sole plate (16), the floor sheet (20) does not have a free edge in contact with the floor and snowplowing of debris may be reduced.

The sole plate (16) and housing (50) may pivot, one relative to the other, about an axis A-A. The axis A-A may be disposed parallel to the axis of the optional rotatable beater bar (44). The axis A-A may be disposed across the housing (50) and intermediate the top and bottom thereof.

The sole plate (16)/housing (50) may pivot through an included angle of 20 to 180 degrees and particularly about 90 degrees. Pivoting 90 degrees to a configuration where the sole plate (16)/housing (50) are approximately or substantially mutually perpendicular provides the benefit that one of the sole plate (16) can maintain contact with the floor should the user encounter a corner.

This arrangement provides the benefit that the device (10) may be used with both the beater bar (44) and sheet (20) for a particular cleaning task, as shown in FIG. 5. Or the device (10) may be used with only the sheet (20) for a particular cleaning task, as shown in FIG. 6.

An optional plow (56) may intercept debris on the floor and divert such debris away from the wheel (40). Particularly, the plow (56) may divert debris to a beater bar (44) or to both beater bars (44), so that the debris can be picked up thereby and directed to the dirt bin (58).

The plow (56) may be flexible, so that it deforms under the weight of the foot (14). This deformation may allow the optional beater bar (44), nozzle (not shown), sheet (20), to better contact the floor during cleaning. The plow (56) may be made of butadiene acrylonitrile copolymer, Shore A 40.

The foot (14) may further comprise a hinge, universal joint, etc. or portion thereof to pivotally receive a handle (12). Optionally and if small enough, the foot (14) may be used without a handle (12).

Optionally, the device (10) may further comprise a vacuum (not shown), to removed debris from the floor. The vacuum may be fan powered, and provide for delivery of lose debris to a dirt bin. The dirt bin (58) may be mounted on the handle (12) of the device (10), as disclosed in U.S. Pat. No. 7,137,169. If a vacuum system is used, the vacuum system may have a pivoting nozzle to allow access to sheet retainers (60), as disclosed in U.S. Pat. No. 7,293,322.

In yet another embodiment (not shown), the device (10) may spray the cleaning solution onto the floor or other target surface. This arrangement provides the benefit that the user can see where the cleaning solution is being applied, with it being blocked under the floor sheet (20). The cleaning solution may be any of the liquid solutions described above, aqueous or otherwise.

The sprayer may be a pump system, as described with respect to commonly assigned U.S. Pat. No. 8,186,898, or a gravity feed system, either permanently/removably attached to the device (10) or a part thereof. Or a separate aerosol or trigger (not shown) pump sprayer may be utilized, as are well known in the art.

If a spray system (not shown) is selected, such a system may allow for use with reusable floor sheets (20), such as the microfiber floor sheets (20) used with commercially available steam devices (10). But the reusable floor sheets (20) have the disadvantages disclosed herein. Thus a spray system may be advantageously used with a single-use floor sheet (20), which is discarded after one cleaning event. If spray is used it will be advantageous to use dry absorbent floor sheets (20) such those described and referenced herein by U.S. Pat. No. 6,716,805 B1, U.S. Pat. No. 7,420,656 B2, U.S. Pat. No. 7,163,349, U.S. Pat. No. 6,101,661, and U.S. Pat. No. 7,144,173.

The floor sheet (20) usable with the present invention may comprise a textured nonwoven and more particularly a hydroentangled nonwoven. The nonwoven may comprise a single ply having three layers. The three layers may comprise a layer of carded fibers interposed between two layers of spunbonded fibers. The floor sheet (20) may be made according to commonly assigned U.S. Pat. Nos. 6,561,354; 6,645,604 and/or 2002/0042962.

Optionally, the floor sheet (20) may comprise a laminate construction, particularly if wet cleaning is contemplated with the present invention. The laminate may comprise at least one floor contacting layer and at least one absorbent, reservoir storage layer. A third, dedicated foot (14) contacting layer is optional and can be used for attachment to the device (10). Thus, the floor sheet (20) of the present invention may comprise 1, 2, 3, 4 or more layers.

When a multi-laminate structure is used, the outer floor contacting layer may contain at least about 30% hydrophobic fibers for oil removal and glide on floors. The floor contacting layer may comprise a polyolefinic, discrete apertured nonwoven. This nonwoven may comprise carded, spunbonded, and/or meltblown fibers.

Materials useful in the floor contacting layer may be sufficiently durable to retain integrity during the cleaning process. In addition, when the cleaning floor sheet (20) is used in combination with a solution, the floor contacting layer may be capable of absorbing liquids and soils, and relinquishing those liquids and soils to the storage layer. This transfer ensures the floor contacting layer will be able to remove additional material from the surface being cleaned.

In order to provide desired integrity, materials particularly suitable for the floor contacting layer include synthetics such as polyolefins (e.g., polyethylene and polypropylene), polyesters, polyamides, synthetic cellulosics (e.g., Rayon), and blends thereof. Such synthetic materials can be manufactured using known process such as carded, spunbond, meltblown, airlaid, needle punched and the like. In one embodiment the floor contacting layer may comprise 50 gsm, 80:20 PP/Rayon nonwoven material.

Various methods can be used to form a suitable fibrous web for use in the floor sheet (20) of the present invention. Such a web can be made by nonwoven dry forming techniques, such as airlaying, or alternatively by wet laying, such as on a paper making machine. Other non-woven manufacturing techniques, including but not limited to techniques such as melt blown, spunbonded, needle punched, and hydroentanglement methods can also be used.

In one embodiment, the dry fibers can be an airlaid nonwoven web comprising a combination of natural fibers, staple length synthetic fibers and a latex binder. The dry fibrous web can be about 20 to 80 percent by weight wood pulp fibers, 10 to 60 percent by weight staple length polyester fibers, and about 10 to 25 percent by weight binder. The dry floor sheet (20) can have a basis weight between about 30 and about 1000 grams per square meter.

The floor sheet (20) may be generally rectangular, and sized to removably fit on the sole plate (16) of the device (10). The floor sheet (20) may have two opposed faces, an upper face to contact the sole plate (16) of the device (10), and a lower face which contacts and cleans the target surface. The floor sheet (20) can function as a scrubbing layer or have additional materials added for scrubbing.

The floor sheet (20) may comprise a perforate or imperforate film, such as is commonly used for of wetted floor sheets (20) in the art. An imperforate film will inhibit, if not prevent, transmission of steam or liquid therethrough, potentially reducing efficacy of the cleaning system.

The floor sheet (20) may be disposable after a single use. By disposable, it is meant that the floor sheet (20) is discarded after a single use of cleaning at least 5, 10, 15, 20 or more square meters and is not laundered or restored.

Pre-moistened floor sheets (20) used in the system of the present invention may be particularly advantageous in that they are always ready for use, and simple to use without special dosing. The user does not have to worry about applying too much cleaning solution, leading to waste, or too little cleaning solution to be efficacious. A pre-moistened floor sheet (20) may be made according to the teachings of commonly assigned U.S. Pat. No. 6,716,805.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm. It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

Except as otherwise noted, the articles "a," "an," and "the" mean "one or more." All documents cited in herein are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A retainer in combination with a rigid, pivotable sole plate of a floor cleaning device, said pivotable sole plate being pivotally attached to a housing of said floor cleaning device, said pivotable sole plate having a first face and a second face opposed thereto, said retainer and sole plate of the floor cleaning device comprising:

at least one finger, said finger being juxtaposed with said first face of said pivotable sole plate of said floor cleaning device and being cantilevered from a proximal end, said finger being deformable in a first direction to receive a cleaning sheet on said pivotable sole plate; and a flexible barrier juxtaposed with said at least one finger and being juxtaposed with said second face of said pivotable sole plate of said floor cleaning device and being exposed when a cleaning sheet is not attached to said pivotable sole plate, said flexible barrier deforming relative to said rigid pivotable sole plate upon contact with said finger, when said finger is deflected to contact said barrier.

2. A retainer in combination with a rigid, pivotable sole plate of a floor cleaning device according to claim 1 wherein said finger is cantilevered from the perimeter of a cavity, said cavity having a closed perimeter defining a center, said retainer comprising plural fingers, each said finger being cantilevered from a proximal end juxtaposed with said perimeter to a respective distal end, said distal ends being juxtaposed with said center of said retainer.

3. A retainer in combination with a rigid, pivotable sole plate of a floor cleaning device according to claim 2 wherein said barrier comprises a membrane.

4. A retainer in combination with a rigid, pivotable sole plate of a floor cleaning device according to claim 3 wherein said barrier comprises a resilient membrane.

5. A retainer in combination with a rigid, pivotable sole plate of a floor cleaning device according to claim 4 wherein said fingers are generally planar in a first plane and said membrane is generally planar in a second plane, said first plane and said second plane being generally mutually parallel, said fingers and said membrane being spaced apart 4 mm to 8 mm.

6. A retainer in combination with a rigid, pivotable sole plate of a floor cleaning device according to claim 5 wherein said membrane completely covers said cavity.

7. A retainer in combination with a rigid, pivotable sole plate of a floor cleaning device according to claim 3 wherein said resilient membrane is taut.

8. A retainer in combination with a rigid, pivotable sole plate of a floor cleaning device according to claim 3 further comprising a sheet engaged therein.

9. A retainer in combination with a rigid, pivotable sole plate of a floor cleaning device according to claim 1 wherein said barrier and said at least one finger contact each other in a free position without said finger being deflected.

10. A retainer in combination with a rigid, pivotable sole plate of a floor cleaning device, said pivotable sole plate being pivotally attached to a housing of said floor cleaning device, said pivotable sole plate having a first face and a second face opposed thereto, and said retainer and sole plate of the floor cleaning device comprising:

at least one cantilevered finger and a barrier being spaced apart and defining a cavity having no intervening component therebetween, said barrier being juxtaposed with one said face of said pivotable sole plate and thereby exposed, said finger being resiliently deflectable in a first direction towards said barrier to attach a cleaning sheet to said first face of said pivotable sole plate of said floor cleaning device, whereby upon contact with said finger said barrier deflects relative to said rigid pivotable sole plate in response thereto, thereby providing a signal to a user attaching a cleaning sheet to said floor cleaning device.

11. A retainer in combination with a rigid, pivotable sole plate of a floor cleaning device according to claim 10 having a center and further comprising a plurality of fingers cantilevered from respective proximal ends to respective distal ends, each of said distal ends of said plurality of fingers deflecting said barrier upon contact therewith.

12. A retainer in combination with a rigid, pivotable sole plate of a floor cleaning device according to claim 11 wherein said barrier comprises flexible strands with discrete spaces therebetween.

13. A retainer in combination with a rigid, pivotable sole plate of a floor cleaning device according to claim 12 wherein said barrier is flaccid.

14. A retainer in combination with a rigid, pivotable sole plate of a floor cleaning device according to claim 12 wherein said barrier is taut or pre-tensioned.

15. A retainer in combination with a rigid, pivotable sole plate of a floor cleaning device according to claim 11 wherein at least some of said fingers are tapered to a point at said respective distal ends, said points of said fingers contacting said membrane in response to insertion force applied by a user.

16. A retainer in combination with a rigid, pivotable sole plate of a floor cleaning device according to claim 15 wherein at least some of said fingers converge to a common point.

17. A retainer in combination with a rigid, pivotable sole plate of a floor cleaning device according to claim 10 wherein said barrier comprises nonwoven material.

18. A retainer in combination with a rigid, pivotable sole plate of a floor cleaning device according to claim 10 wherein said barrier comprises a membrane.

19. A retainer, in combination with a rigid, pivotable sole plate of a floor cleaning device, said pivotable sole plate being pivotally attached to a housing of said floor cleaning device, said pivotable sole plate having a first face and a second face opposed thereto, and said retainer and sole plate of the floor cleaning device comprising:

a flexible barrier;

at least one cantilevered finger being bendable in a first direction towards said barrier to thereby attach a cleaning sheet to said first face of said pivotable sole plate of said floor cleaning device, said barrier being urged away from said rigid pivotable sole plate by said bending of said finger.

* * * * *